US006917037B2

(12) United States Patent
Ootake et al.

(10) Patent No.: US 6,917,037 B2
(45) Date of Patent: Jul. 12, 2005

(54) MASS SPECTRUM ANALYZING SYSTEM

(75) Inventors: Atsushi Ootake, Hitachiota (JP); Kinya Kobayashi, Hitachi (JP); Kiyomi Yoshinari, Hitachi (JP); Atsumu Hirabayashi, Kodaira (JP); Izumi Waki, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 10/770,551

(22) Filed: Feb. 4, 2004

(65) Prior Publication Data

US 2004/0169138 A1 Sep. 2, 2004

(30) Foreign Application Priority Data

Feb. 27, 2003 (JP) ..... 2003-050485

(51) Int. Cl.[7] ..... H01J 49/26

(52) U.S. Cl. ..... 250/282; 250/281; 436/173; 702/27

(58) Field of Search ..... 250/281, 282, 250/288; 436/173; 702/27

(56) References Cited

U.S. PATENT DOCUMENTS 5,404,011 A * 4/1995 Wells et al. ..... 250/282
6,624,408 B1 * 9/2003 Franzen ..... 250/282
6,745,134 B2 * 6/2004 Kobayashi et al. ..... 702/27

FOREIGN PATENT DOCUMENTS

JP 5-164751 6/1993
JP 2000-171442 6/2000

* cited by examiner

*Primary Examiner*—Jack I. Berman
(74) *Attorney, Agent, or Firm*—Dickstein Shapiro Morin & Oshinsky LLP

(57) ABSTRACT

The measurement throughput and the precision in sample identification are improved in a tandem type mass spectrograph. Thus, in a mass spectrum analyzing system utilizing a tandem type mass spectrograph in which the selection of an ionic species to serve as the measurement target, dissociation thereof and spectral measurement are repeated in n stages, the ionic species to be measured in $MS^n$ is selected based on the mass-to-charge ratios (m/z values) obtained as a result of the spectral analysis in $MS^{n-1}$ ($n \geqq 2$), and this procedure is repeated until the sequence of a required number of amino acids is determined.

23 Claims, 9 Drawing Sheets

MASS SPECTRUM ANALYZING SYSTEM

FIELD OF THE INVENTION

The present invention relates to a mass spectrum analyzing system in which a mass spectrograph is used, and more particularly to a mass spectrum analyzing system for identifying, with high precision, the structure of a biopolymer such as a polypeptide or sugar.

BACKGROUND OF THE INVENTION (1) According to the conventional methods of mass spectrometric analysis, the measurement target is ionized, the ions formed are sent to a mass spectrometer, and the mass numbers of the dissociation products are measured. In a tandem type mass spectrograph in which multistage dissociation is possible, an ionic species having a certain mass number alone is selected from among the ionic species formed by the dissociation reaction and is further caused to collide with gas molecules.

In this manner, second-stage, third-stage, . . . , and nth-stage dissociation reactions are induced, and the mass numbers of the ionic species formed in each stage are measured. In this case, the ionic species to be dissociated in each of the second and subsequent stages is generally selected according to the findings obtained by the measurer.

(2) JP-A-2000-171442, for instance, may be mentioned as a prior art document dealing with the selection of an ionic species to be measured. In the patent document, mention is made of a method of selecting that ionic species which shows the highest spectral intensity. Further, the method comprising selecting some species high in spectral intensity or selecting the one k-th (k being selected by the measurer) in spectral intensity is used in some instances as a method generally employed.

(3) Generally, use is made of the method comprising matching the spectrum measured with a database in which spectral data on structurally known polypeptides as collected in advance are stored, and thus structurally identifying the polypeptide in question. For compounds other than proteins, JP-A-H05-164751 (1993) is concerned with the structural identification thereof utilizing a database.

(1) In carrying out the n-th stage dissociation (hereinafter referred to as "$MS^n$") according to the prior art methods, the ionic species to be subjected to $MS^n$ is selected based on the measurer's findings from the dissociation spectrum obtained in the (n−1)th stage ($MS^{n-1}$). Therefore, the $MS^n$ measurement is troublesome and, generally, the spectral analysis is made only to the stage of n=2 in many instances. At the stage of n=2, no sufficient spectral information necessary for the purpose of identification may be obtained in some instances.

(2) The above-cited Patent Document 1 is concerned with the establishment of optimum analysis conditions, hence cannot always be said to be best advisable from the viewpoint of improving the precision in identifying biopolymers, in particular polypeptides.

Further, when the ion selection is made based on the intensity information, there arises the possibility of failure in selecting the optimum ion for obtaining the structural information. It is necessary to effectively utilize the mass-to-charge ratio (m/z) values of the ions formed.

(3) Supposing that the number of amino acid residues constituting a peptide chain is K and the number of amino acid species is 20, the number of possible amino acid sequences becomes as large as $K^{20}$. If chemical modifications of amino acid side chains are taken into consideration, that number will become still larger.

Therefore, it is almost impossible to prepare a database taking chemical modifications into consideration and carry out searching within a practical period of time.

On the other hand, for chemical modification group elimination, a chemical pretreatment is necessary, and this may cause a decrease in measurement throughput. The database-based matching software currently available on the market has a problem in that only measurements until $MS^2$ can be dealt with.

For solving the problems discussed above, it is necessary to select an optimum ionic species in each stage of $MS^n$ ($n \geqq 3$) and thereby effectively utilize the information contained in the $MS^n$ spectrum.

SUMMARY OF THE INVENTION

In accordance with the present invention, the above-mentioned problems are solved by providing a mass spectrum analyzing system using a tandem type mass spectrograph in which a measurement target substance is ionized and an ionic species having a specific mass number is selected from among the ionic species formed and is further dissociated, and such measurement target ionic species selection and dissociation are repeated in n stages, which system is characterized in that whether the n-th stage tandem mass analysis is to be carried out or not is determined based on all mass-to-charge ratio (m/z) peaks obtained by the spectral measurement in the (n−1)th stage. This system makes it possible to obtain structural information on the measurement target by a necessary but minimum number of measurements.

In a preferred embodiment of the above-mentioned mass spectrum analyzing system, the ionic species selection in the tandem mass analysis in the n-th stage is made by a selection means built-in in the spectrograph or connected thereto from the outside based on all mass-to-charge (m/z) peaks obtained in the spectral measurement in the (n−1)th stage. In this way, it becomes possible to effect the multistage dissociation more efficiently and obtain more detailed structural information on the measurement target.

In a preferred embodiment of the above-mentioned mass spectrum analyzing system, the mass spectrum obtained in the n-th stage of tandem mass analysis is compared with a database and, in case of agreement, the measurement is finished or, in case of nonagreement, the spectral measurement in the (n+1)th stage is carried out. In this way, a structural identification can be made by a necessary but minimum number of measurements and, when there is no structure registered in the database, detailed spectral measurements can be carried out.

In a preferred embodiment of the above-mentioned mass spectrum analyzing system, the mass spectrum obtained in the n-th stage of tandem mass analysis is compared with a database and, in case of agreement, the measurement is finished or, in case of nonagreement, the spectral measurement in the (n+1)th stage is carried out until an agreement with the database is obtained. In this way, it becomes possible to make the structural identification with certainty referring to the database.

In a preferred embodiment of the above-mentioned mass spectrum analyzing system, the ionic species selection and spectral measurement are automatically repeated. In this way, the measurer's procedure for spectrum examination and ion selection for further measurement can be omitted and, thus, the measurement turnaround time can be shortened.

In a preferred embodiment of the above-mentioned mass spectrum analyzing system, the measurement target is one of polypeptides, sugars, phosphoric acid, oxygen, hydrogen, alkyl groups, organic acid related compounds, and further other compounds, or a protein or polypeptide chemically modified by such a compound. In this case, biopolymers can be structurally identified with high precision using the tandem type mass spectrograph.

In a preferred embodiment of the mass spectrum analyzing system, the candidate structures of dissociated ionic species are predicted for such a protein, polypeptide, chemically modified protein, or chemically modified polypeptide as mentioned above and, based on the results of the prediction, the sequence of amino acid residues constituting the peptide chain is predicted. Thus, in case of failure to reveal the sequence exceeding M residues contained in the peptide chain, a dissociated ionic species containing the largest number of amino acid residues in the unknown sequence is selected and dissociated, and the ionic species selection and dissociation are repeated until the sequence exceeding M residues in the peptide chain becomes revealed.

In this way, it becomes possible to identify, to a desired extent and with high precision, the structure of a protein, polypeptide, chemically modified protein, or chemically modified polypeptide.

In a more preferred embodiment of the mass spectrum analyzing system, the value of the above-mentioned M is 4, 5, 6 or 7. In this way, the whole amino acid sequence of a protein or polypeptide containing a confirmed amino acid sequence can be estimated by referring to a database.

In a more preferred embodiment of the mass spectrum analyzing system, the value of the above-mentioned M is specified by the measurer on the occasion of measurement or in a stage prior to measurement. In this way, an arbitrary number of amino acid residues in the measurement target can be identified.

In a preferred embodiment of the above-mentioned mass spectrum analyzing system, the mass spectra from the second to n-th stages are added, or weighted and added, and the resulting sum spectrum is used to estimate the structure of the measurement target. In this way, structural identification becomes possible by comparing with the dissociation spectral data from up to the second stage, without preparing any database corresponding to multistage dissociation spectra.

Further, in a preferred embodiment of the above-mentioned mass spectrum analyzing system, the subsequent dissociation and measurement cycle is repeated until the total number of amino acid-due peak groups among the peak groups in the sum spectrum becomes not less than J. In this way, the measurement throughput can be improved, since only a necessary but minimum number of dissociation and measurement cycles are required to be carried out.

In a preferred embodiment of the above-mentioned mass spectrum analyzing system, the value of J is 4, 5, 6 or 7. In this case, the whole amino acid sequence of a protein or polypeptide containing a confirmed amino acid sequence can be estimated by referring to a database.

In a more preferred embodiment of the above-mentioned mass spectrum analyzing system, the value of the above-mentioned J is specified by the measurer on the occasion of measurement or in a stage prior to measurement. In this way, it becomes possible to identify an arbitrary number of amino acid residues in the measurement target.

In a preferred embodiment of the above-mentioned mass spectrum analyzing system, the above-mentioned chemically modified protein or chemically modified polypeptide is deprived of the modifier compound in the n-th stage of dissociation, and the resulting modifier compound-free polypeptide or sugar is subjected to dissociation in the (n+1)th stage of dissociation. In this way, a mass spectrum can be obtained for the chemical modification-free structure.

Further, in comparing the actually measured spectral data with a database, a database for chemical modification-free structures can be used and, as a result, rapid structure searching becomes possible.

In this way, it becomes possible to identify the protein- or polypeptide-modifying compound. Further, the chemical pretreatment for eliminating the chemical modifier becomes unnecessary, and the measurement throughput can be improved.

In a preferred embodiment of the above-mentioned mass spectrum analyzing system, the modifier compound eliminated is structurally identified. In this way, it becomes possible to identify the protein- or polypeptide-modifying compound.

In a preferred embodiment of the above-mentioned mass spectrum analyzing system, when it is difficult, due to closeness in mass number, to judge as to whether there is one amino acid residue or a pair of two amino acid residues among the amino acids constituting a protein, polypeptide, chemically modified protein or chemically modified polypeptide, an ionic species containing the amino acid(s) in question is selected and subjected to dissociation. In this way, the number of candidate amino acid residue sequences can be limited, and the precision in structural identification can be improved.

In a preferred embodiment of the above-mentioned mass spectrum analyzing system, when it is anticipated that the candidate structure of an ionic species contains one of tryptophan (Trp), asparagine (Asn), glutamine (Gln), glutamic acid (Glu) and arginine (Arg), an ionic species expectedly containing such amino acid residue is selected and subjected to dissociation. In this way, the precision in amino acid residue sequence identification can be improved.

In a preferred embodiment of the above-mentioned mass spectrum analyzing system, the candidate structures of dissociated ionic species are predicted for a sugar or chemically modified sugar and, based on the results of such prediction, the monosaccharide sequence or the number of such sequences is estimated. In case of failure to reveal the sequence of Ma or more monosaccharides in the sugar chain thereby, a dissociated ionic species most abundantly containing the monosaccharides the sequence of which is unknown is selected and subjected to dissociation, and the ionic species selection, dissociation and measurement cycle is repeated until the sequence of Ma or more monosaccharides in the sugar chain is revealed. In this way, the monosaccharides constituting the sugar chain structure can be identified.

Further, in a preferred embodiment of the above-mentioned mass spectrum analyzing system, the value of the above-mentioned Ma is 4, 5, 6 or 7. In this case, it is possible to estimate the whole sugar chain by comparing the revealed sugar chain sequence comprising 4 to 7 monosaccharides with a database.

In a more preferred embodiment of the above-mentioned mass spectrum analyzing system, the value of Ma is specified by the measurer on the occasion of measurement or in a stage prior to measurement. In this way, it becomes possible to identify an arbitrary number of sugar chain-constituting monosaccharides.

In a preferred embodiment of the above-mentioned mass spectrum analyzing system, the subsequent dissociation and measurement cycle is repeated until the number of sugar-due peak groups among the peak groups in the sum spectrum becomes not less than Ja. In this way, it is possible to identify the monosaccharides constituting the sugar chain structure.

In a more preferred embodiment of the above-mentioned mass spectrum analyzing system, the value of Ja is 4, 5, 6 or 7. In this case, it becomes possible to estimate the whole sugar chain by comparing the revealed sequence comprising 4 to 7 sugars with a database.

Further, in a more preferred embodiment of the above-mentioned mass spectrum analyzing system, the value of Ja is specified by the measurer on the occasion of measurement or in a stage prior to measurement. In this way, it becomes possible to identify an arbitrary number of monosaccharides constituting the sugar chain.

DETAILED DESCRIPTION OF THE PREFERRED EMBODIMENTS

EXAMPLE 1

Figure 1:
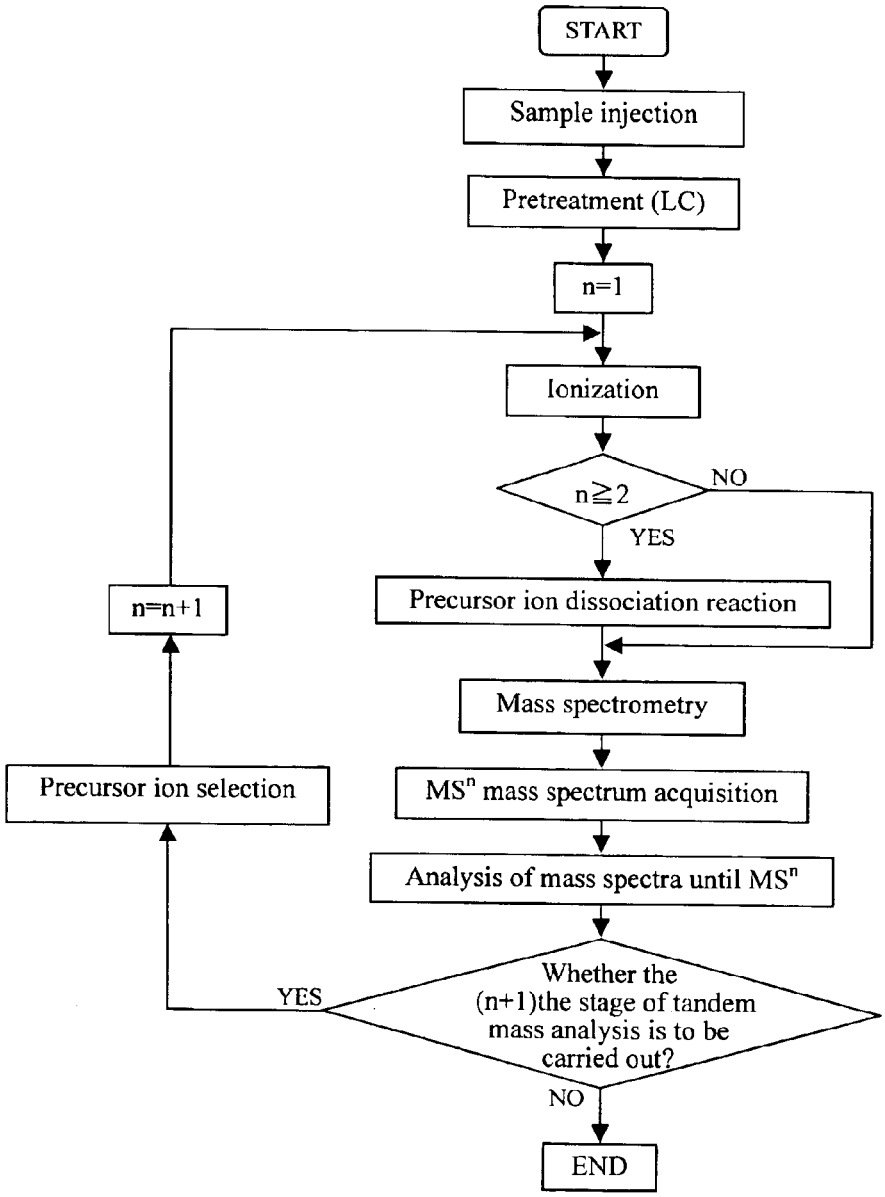
FIG. 1 is a flow chart illustrating an embodiment of the mass spectrum analyzing system according to the invention.

FIG. 1 is a flow chart illustrating an embodiment of the mass spectrum analyzing system according to the invention. In this example, a polypeptide composed of 30 amino acid residues is digested with a digestive enzyme to give a mixture of polypeptides each composed of about 5 to 7 residues, and this mixture is used as the sample.

First, the sample is injected into a pretreatment device (LC: liquid chromatography) and separated into sample species, followed by ionization. The ionization method to be employed here is the electro spray ionization (ESI) method known as a mild ionization method.

The masses of the ionized sample species are detected by trapping mass spectrometry. The information about the mass numbers of the ions detected and the spectral intensities is transferred to a data processor and stored as mass spectrum data (referred to as $MS^1$; hereinafter, the mass spectrum measured in the n-th run is referred to as $MS^n$) in a storage.

Figure 2:
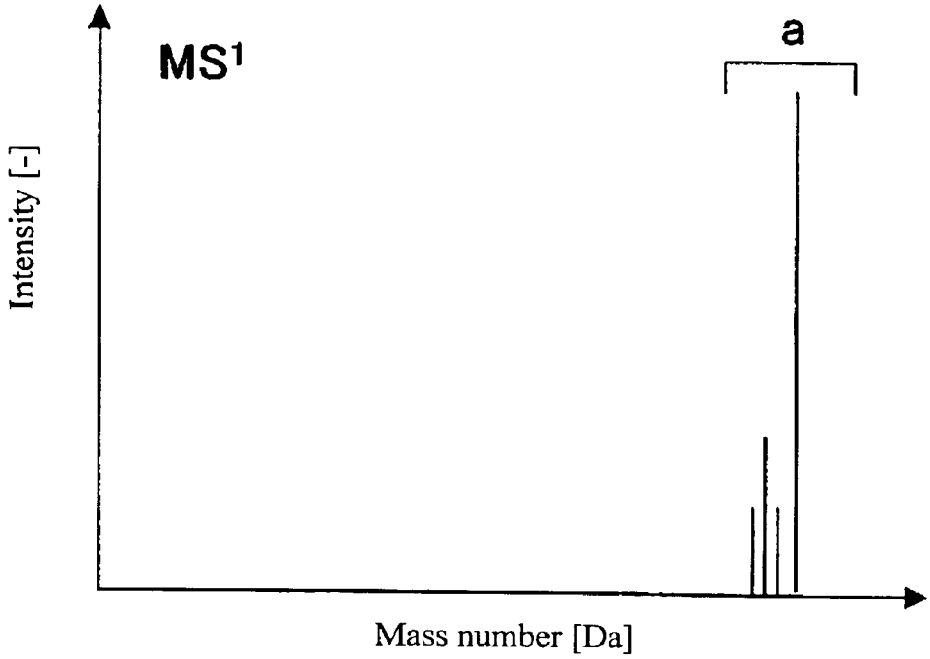
FIG. 2 is a mass spectrum obtained in Example 1 according to the invention.

The thus-measured mass spectrum ($MS^1$) occurs as a spectrum such as shown in FIG. 2, and mostly ionized sample species alone are observed.

The built-in software in the data processor displays, on an input/output device, a list of those candidate amino acid sequences and numbers of constituent amino acids which are possible in view of the mass numbers of the ions detected. It also displays, on the input/output device, the mass number of each ion and candidates of the amino acid sequence thereof.

When there are a plurality of peaks in the $MS^1$ spectrum, the measurer, referring to the information of the amino acid candidates, selects an ion the structure of which is to be identified, and gives an order to that effect to an ion selection section via the input/output device. In this example, the peak a ions in the spectrum shown in FIG. 2 are selected.

Then, the sample is again ionized for measuring the $MS^2$ spectrum. The trapping mass spectrograph selects the ions having the specified mass numbers in the $MS^1$ spectrum and causes them to collide with gas molecules for dissociation of the ions. The thus-formed plurality of ionic species is introduced into the trapping mass spectrograph to give such a mass spectrum ($MS^2$) as shown in FIG. 3.

Figure 3:
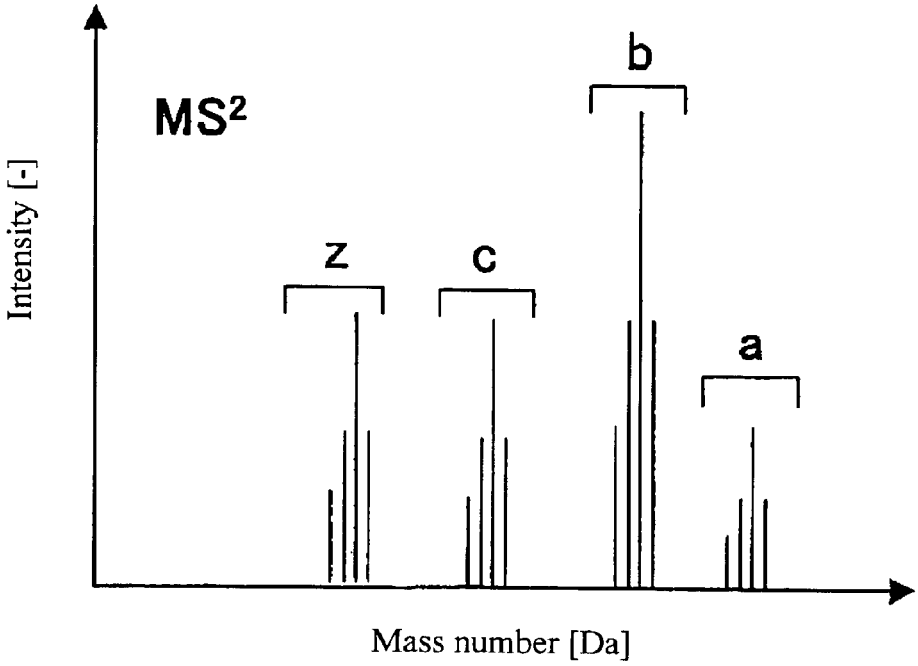
FIG. 3 is a mass spectrum obtained in Example 1 according to the invention.

The spectral data of FIG. 3 is analyzed by the built-in software in the data processor. Thus, a list of amino acid sequence candidates and a list of numbers of constituent amino acids are displayed on the input/output device. On that occasion, a, b, c and z are simultaneously displayed in terms of amino acid sequences and numbers of amino acids corresponding to the respective peak groups.

Based on the information thus obtained, it was found that the amino acid sequences constituting b and c are unidentifiable, since the number of candidates for each is 10 or more. Therefore, an ionic species belonging to the c peak group out of b and c was selected and further subjected to dissociation and measurement. The thus-obtained mass spectrum ($MS^3$) is shown in FIG. 4.

Figure 4:
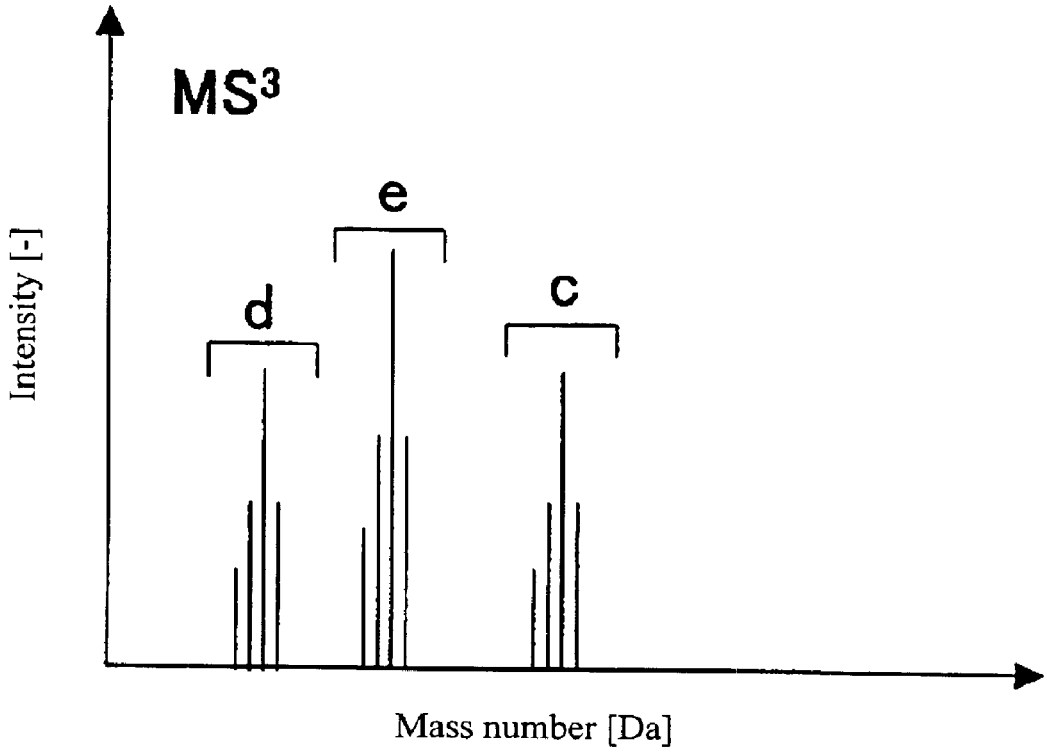
FIG. 4 is a mass spectrum obtained in Example 1 according to the invention.

By analyzing the spectrum of FIG. 4 in the data processor, it is possible to determine the amino acid sequence of the c peak group and, further, identify the amino acid sequence constituting the peak group a.

In this manner, the measurer, referring to the results of analysis of the $MS^{n-1}$ ($n \geqq 2$), selects an ionic species to be measured for $MS^n$. This procedure is repeated until the number of candidate structures is sufficiently decreased. At a stage in which the whole amino acid sequence is determined, the measurement is finished. When, on that occasion, a next sample is to be subjected to measurement, the sample is again introduced, and the above procedure is carried out.

As described above, it becomes possible, according to this example, to improve the precision in identification by selecting an optimum ionic species in the $MS^3$ and subsequent measurements.

EXAMPLE 2

Figure 5:
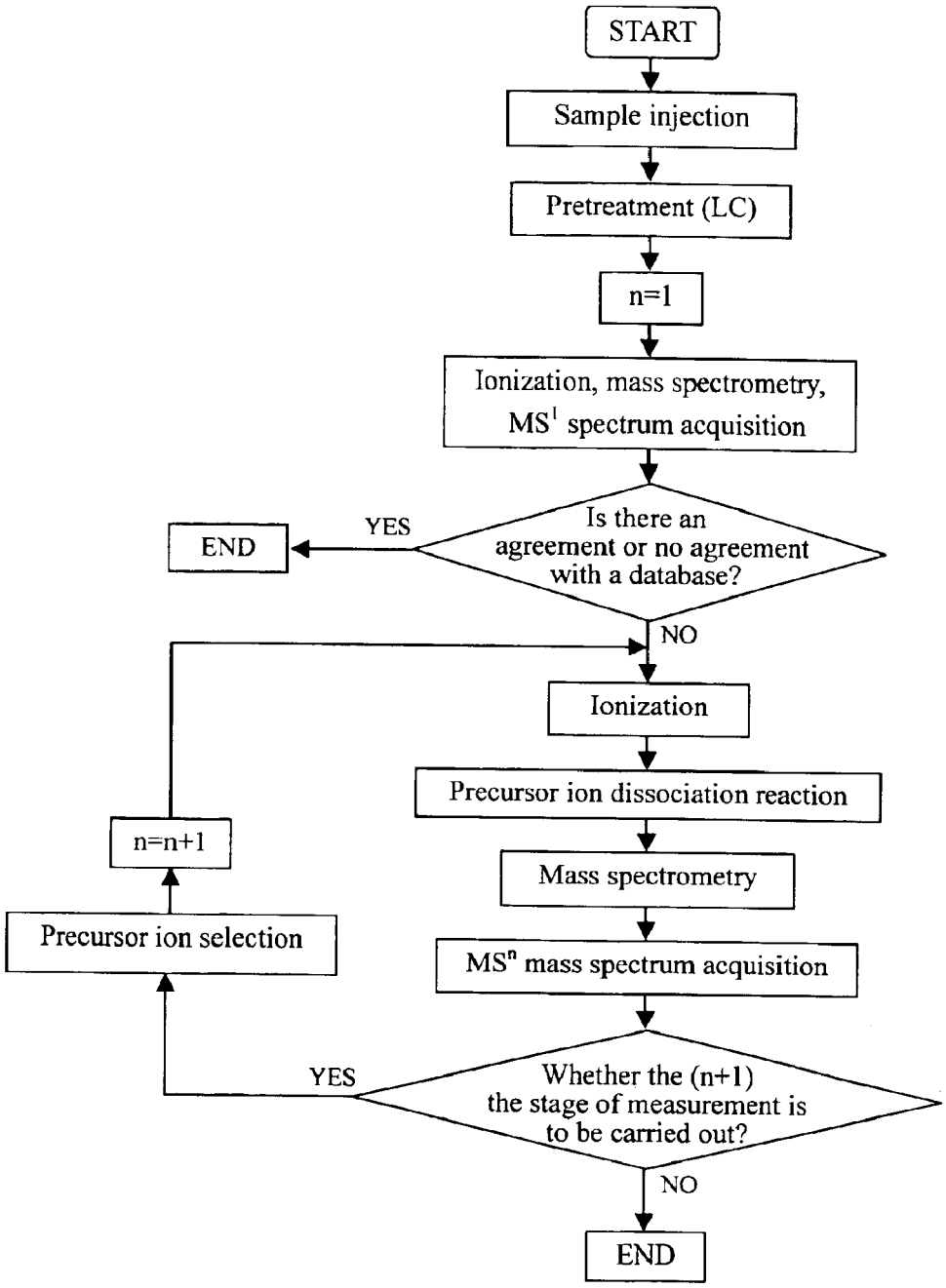
FIG. 5 is a chart illustrating the mass spectrum analyzing system employed in Example 2 according to the invention.

Referring to FIG. 5, a mass spectrum analyzing system according to the present invention is described.

FIG. 5 is a flow chart illustrating the mass spectrum analyzing system of the invention and, in this case, a sugar sample is used.

First, the sample is injected into a pretreatment device (LC: liquid chromatography) and separated into sample species, followed by ionization. The ionization method to be employed here is the electro spray ionization (ESI) method known as a mild ionization method. The ionized sample species are measured by a mass spectrograph to give an $MS^1$ spectrum.

Figure 6:
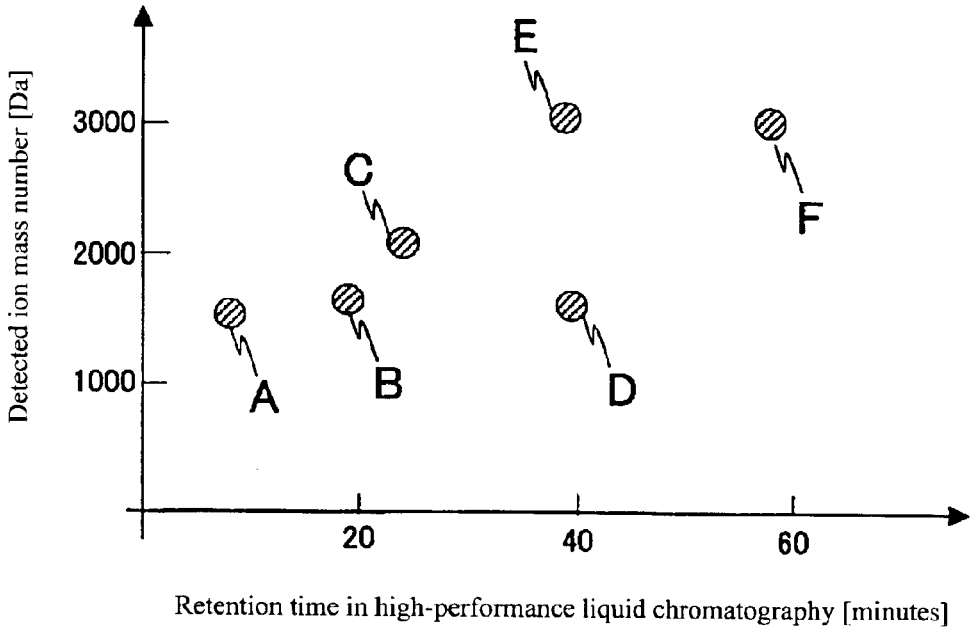
FIG. 6 is a graphic representation of a sugar chain data base used in an example according to the invention.

The mass numbers of the ions obtained in $MS^1$ and the retention times thereof in LC are compared with such a database as shown in FIG. 6. The database consists of retention times, mass numbers of ions obtained in $MS^1$, and sugar chain species. In the case of FIG. 6, six sugar chains, A to F, have been registered.

The sugar chain measured in this example had a retention time in LC of about 20 minutes, and the ionic species obtained in $MS^1$ had a mass of 1700 Da, hence the measurement target sugar chain can be identified as "B". In case of success in identifying the sugar chain in question based on such agreement with a database as in this case, the measurement is finished. In case of no agreement upon comparison with the database, the $MS^2$ and subsequent spectrum measurements are further carried out, and the $MS^n$ measurement is repeated until the measurer obtains the information necessary for structure identification.

As mentioned above in this example, database utilization makes it possible to make structure identification by a minimum number of measurements. In case of failure in structure identification using the database, a necessary number of measurements for structure identification are carried out.

EXAMPLE 3

While, in Example 2, whether the subsequent measurement is to be carried out is judged based on the results of comparison of the MS1 spectrum with a database, the same effects can also be produced by carrying out the comparison with a database in all measurement stages (MSn, $n \geqq 1$). In this case, however, a database capable of coping with the $MS^n$ measurements is required.

EXAMPLE 4

While, in Example 1, the ionic species selection is made by the measurer, it is possible to automatically repeat the measurement and measurement target identification by causing a data processor to carry out the ionic species selecting operation.

According to this example, it is possible to omit the measurer's procedure for selecting the ion to be measured and thereby reduce the measurement turnaround time.

EXAMPLE 5

While, in the preceding examples, a polypeptide or sugar is employed as the measurement target, the same effects can also be produced when the measurement target is one of sugars, phosphoric acid, oxygen, hydrogen, alkyl groups, organic acid related compounds, or of other compounds, or a protein or polypeptide chemically modified by such a compound.

EXAMPLE 6

Referring to the flow chart shown in FIG. 5, an embodiment of the mass spectrum analyzing system according to the invention is described in the following.

Figure 7:
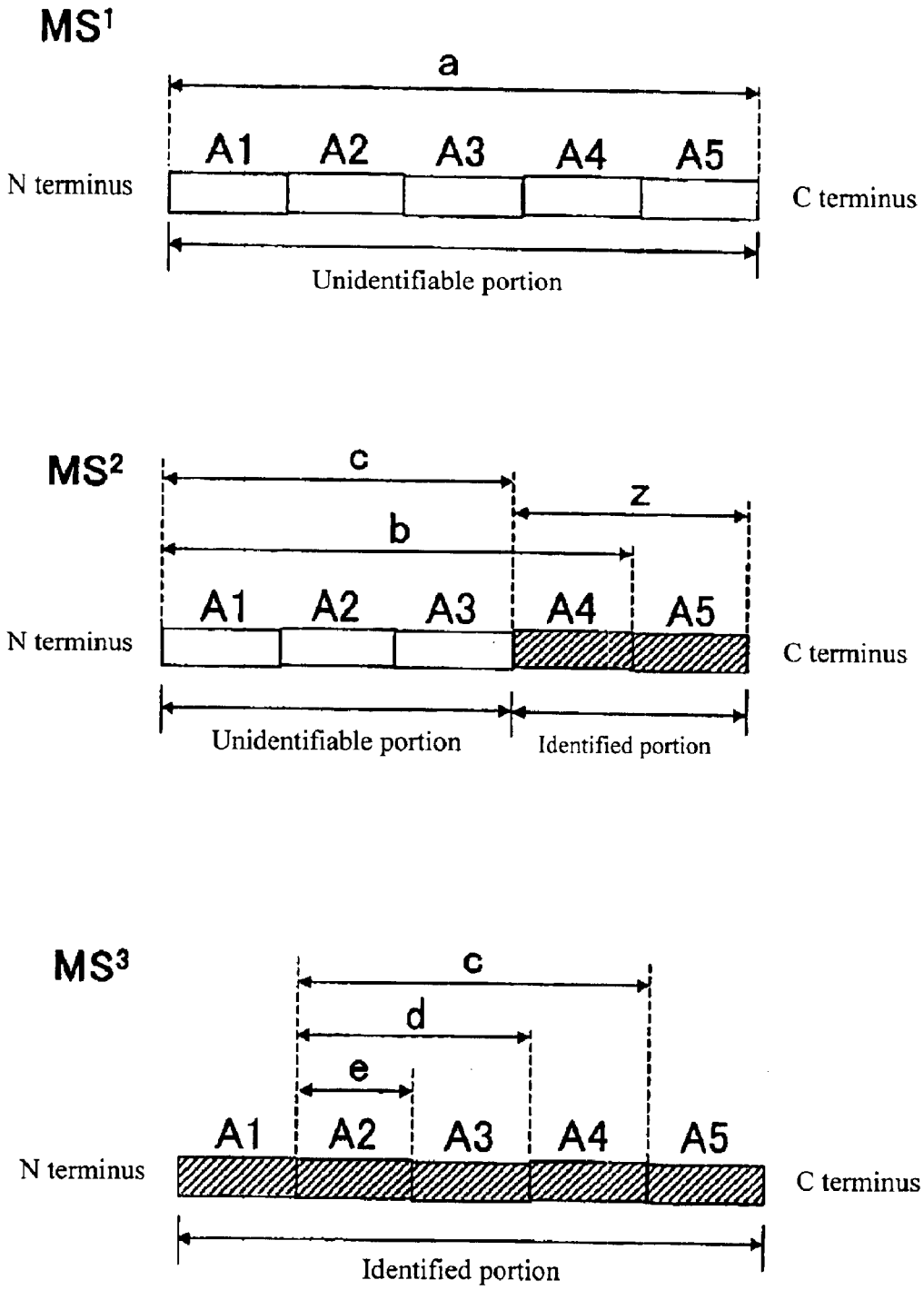
FIG. 7 is a mass spectrum analysis chart resulting from Example 1 according to the invention.

FIG. 7 illustrates how the amino acid sequence is identified based on the $MS^1$ to $MS^3$ spectra obtained in Example 1. In FIG. 7, the structure of the parent ion (a) is unidentifiable when the $MS^1$ spectrum alone is referred to; only the mass number thereof is known.

Then, in the $MS^2$ spectrum, an ion (b) resulting from elimination of one amino acid residue from the parent ion, an ion (c) resulting from elimination of two amino acid residues, and an ion (z) composed of the two C-terminal side amino acids of the parent ion are observed.

The amino acid residues A4 and A5 can be identified by mass number comparisons. On the other hand, the A1–A3 portion remains unidentifiable. Therefore, b or c, which comprises the residues A1 to A3, is selected as the ion to be measured, and it is further dissociated for $MS^3$ spectrum measurement. Since b contains the residue A4 already identified, the spectrum obtained becomes more complicated as compared with c. For avoiding such complexity, the ion c, which is smaller in mass number and in number of residues, is preferably selected.

In the $MS^3$ spectrum, the ions of d and e are found as a result of dissociation of c. Thus, the residues A2 and A3 can de identified by mass number comparisons. Since the mass number of the parent ion (a) is already known, the residue A1 can be identified.

In this example, a peak group comprising a maximum number of unidentified amino acid residues, preferably such a peak group smallest in mass number, is selected and subjected to $MS^n$ ($n \geqq 3$) spectrum measurement.

It is also possible to carry out the above selecting operation automatically. The measurement is repeated until an amino acid sequence composed of M or more residues (M=5 in this example) becomes revealed. In this example, the sequence composed of 5 residues can be determined in the stage of $MS^3$ and, since the number of amino acid residues constituting the polypeptide is 5, the measurement is finished.

As described above, it is possible, in accordance with this example, to identify the structure of a polypeptide with high precision in a desired range.

EXAMPLE 7

In this example, the case in which the number M of amino acid residues to be identified is 4 to 7 is described.

The information about the amino acid sequences of known proteins has been accumulated in such a database as PDB (Protein Data Base). By comparing the amino acid sequences found with such a sequence information database, it is possible to estimate the sequence structure of the whole sample protein before enzymatic digestion. For this purpose, it is sufficient that amino acid sequences comprising about 5 residues are known.

In cases where the number of resides constituting the protein used as the sample is small or where the protein has a special amino acid sequence, the whole amino acid sequence can be estimated when sequences comprising 4 residues are known.

Further, when the sample is expected to comprise an amino acid sequence(s) common to various proteins, the whole amino acid sequence can be estimated when 6 or 7 is selected as the number of residues to be identified.

According to this example, the whole amino acid sequence of a sample can be estimated by revealing amino acid sequences composed of 4 to 7 residues as contained in the sample.

EXAMPLE 8

When a value is given to M in Example 6 or 7, an arbitrary number of sequences in the measurement target can be revealed.

EXAMPLE 9

Figure 8:
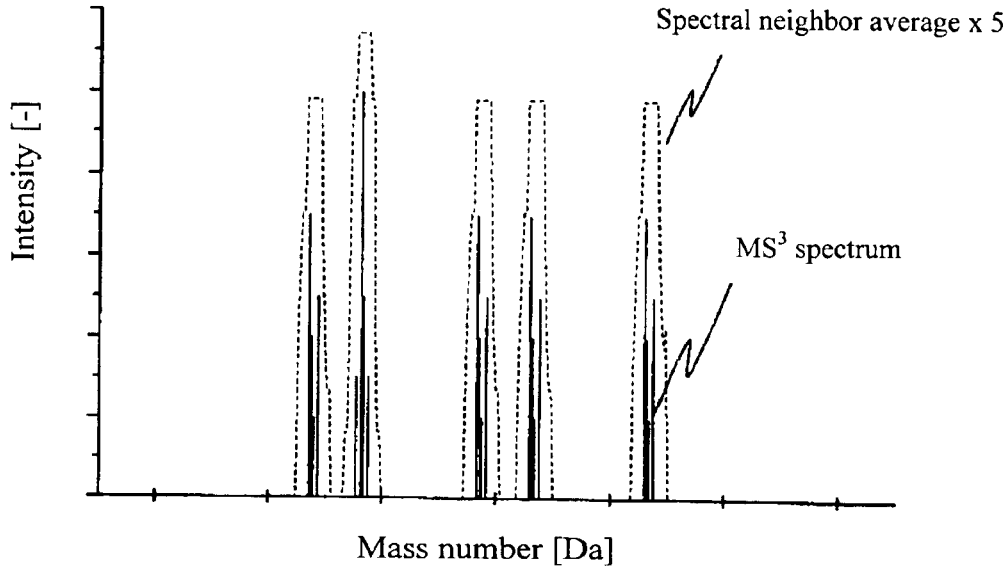
FIG. 8 is a mass spectrum analysis chart resulting from Example 9 according to the invention.

This example is described referring to FIG. 8. FIG. 8 shows the result of addition of the $MS^2$ and $MS^3$ spectra obtained by measurement of a polypeptide. Each dotted line peak shows the result obtained from the above spectra by neighbor averaging and smoothing.

In this case, the mass range for neighbor averaging is 18 Da. This is for the purpose of taking a derivative spectrum resulting from elimination of water (mass number 18 Da) or ammonia (mass number 17 Da) into consideration as a spectrum derived from one amino acid residue.

FIG. 8 has 5 dotted line maxima and, thus, it can be understood that the spectrum can be classified into 5 peak groups. Since the measurement target is a polypeptide, each peak group can be considered as an amino acid-derived one. Therefore, it becomes known that the measurement target contains at least 5 amino acid residues.

By analyzing the mass numbers of these peak groups, it is possible to specify the five amino acid residues. When the number J of amino acid residues to be specified is expected to be 5, the measurement may be finished at the stage in which the above spectrum is obtained.

As described above, it is possible, according to this example, to limit the number of measurements and thereby minimize the measurement turnaround time.

EXAMPLE 10

The case in which the value of J is one of 4 to 7 is described. The information about the amino acid sequences of known proteins has been accumulated in such a database as PDB (Protein Data Bank). By comparing the amino acid sequences found with such a sequence information database, it is possible to estimate the sequence structure of the whole sample protein before enzymatic digestion. For this purpose, it is sufficient that amino acid sequences comprising about 5 residues are known.

In cases where the number of resides constituting the protein used as the sample is small or where the protein has a special amino acid sequence, the whole amino acid sequence can be estimated when sequences comprising 4 residues are known.

Further, when the sample is expected to comprise an amino acid sequence(s) common to various proteins, the whole amino acid sequence can be estimated when 6 or 7 is selected as the number of residues to be identified.

According to this example, the whole amino acid sequence of a sample can be estimated by revealing amino acid sequences composed of 4 to 7 residues as contained in the sample.

EXAMPLE 11

A method of carrying out the measurement according to the invention following elimination of the modifier moiety of a chemically modified polypeptide is described.

Figure 9:
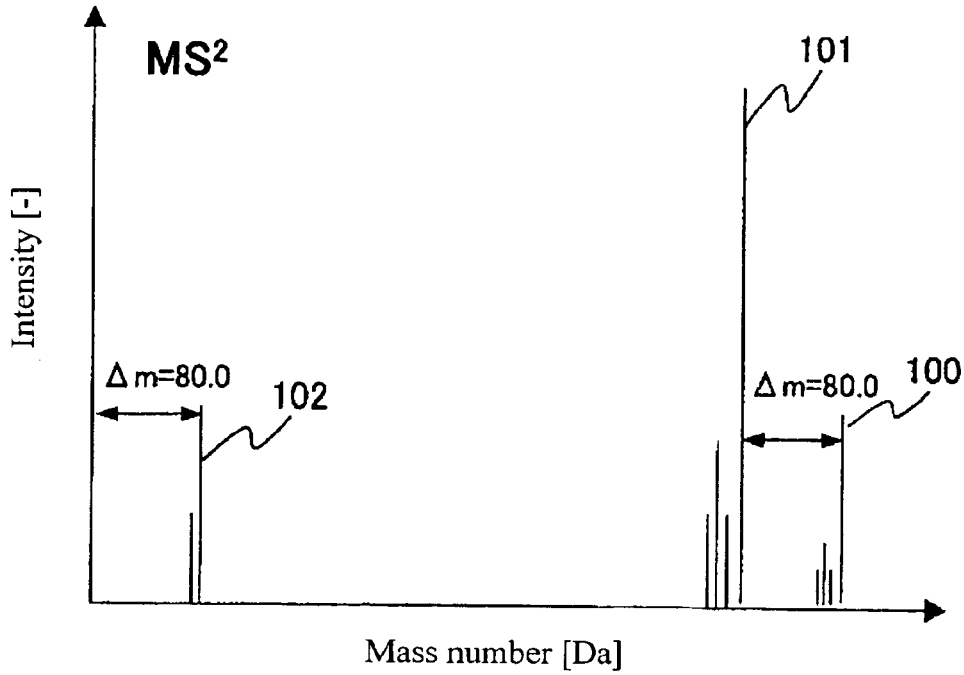
FIG. 9 is a mass spectrum analysis chart resulting from Example 11 according to the invention.

FIG. 9 is the $MS^2$ spectrum of a chemically modified polypeptide. The spectrum shown in FIG. 9 is constituted of three main peaks, namely peaks 100, 101 and 102.

The difference Am between the peak 100 and peak 101 is 80.0 Da and, likewise, the mass number of peak 102 is 80.0 Da. Thus, it is presumable that the peak 100 is derived from a chemically modified polypeptide, the peak 101 from a polypeptide deprived of the chemical modifier, and the peak 102 from phosphoric acid, which is the modifier compound. Therefore, if the peak 101 ion is selected for the $MS^2$ and subsequent measurements, the same spectra as those of the corresponding unphosphorylated polypeptide will be obtained.

Other possible chemical modifications than phosphorylation and the resulting Δm values are as shown in Table 1.

TABLE 1

| Chemical modification | Δm[Da] |
|---|---|
| Formylation | 28.01 |
| Acetylation | 42.04 |
| Myristylation | 210.36 |
| Hydroxylation | 15.99 |
| Myristylation | 210.4 |
| Glucosylation (when the sugar is a hexose) | 162.14 |

Polypeptides resulting from such a chemical modification as shown in Table 1 all give a peak lower by Δm in mass number than a peak maximum in mass number, as mentioned hereinabove and, further, a peak with the mass number Δm appears on the smaller mass number side. By measuring the ion smaller by Δm in mass number than the peak maximum in mass number, it is possible to measure the chemically unmodified peptide.

As described above, as a result of chemical modifier elimination in this example, it is possible to identify the structure of the chemically modified measurement target, without using a database established by taking chemical treatments and modified structures into consideration.

EXAMPLE 12

A method of identifying the modifier compound in Example 11 is described in the following.

First, the $MS^1$ spectrum of the modified measurement target is measured, and such a spectrum as shown in FIG. 7 is obtained.

As mentioned in Example 9, the peak 102 in FIG. 7 shows a mass number of 80.0 Da, and the difference in mass number between the peaks 101 and 100 is also 80.0 Da. Therefore, the peak 102 is presumably due to ionization of a compound resulting from elimination of the modifier compound with a mass number of 80.0 Da (corresponding to phosphoric acid) from the peak 100 ion.

For other modifying compounds than phosphoric acid, the Δm values are as shown in Table 2.

TABLE 2

| Residue of amino acid 1 | Mass number[Da](①) | Residue of amino acid 2 | Mass number[Da](②) |
|---|---|---|---|
| Trp | 186.2 | Glu-Gly | 186.2 |
| Trp | 186.2 | Ala-Asp | 186.2 |
| Trp | 186.2 | Ser-Val | 186.2 |
| Trp | 186.2 | Lys-Gly | 185.2 |
| Trp | 186.2 | Gln-Gly | 185.2 |
| Trp | 186.2 | Asn-Ala | 185.2 |
| Asn | 114.1 | Gly-Gly | 114.1 |
| Lys | 128.2 | Gly-Ala | 128.1 |
| Gln | 128.1 | Gly-Ala | 128.1 |
| Glu | 129.1 | Gly-Ala | 128.1 |
| Arg | 156.2 | Val-Gly | 156.2 |

As the value of Δm increases (Δm≧50 Da), it becomes difficult to make an identification using the $MS^1$ spectrum alone. Therefore, the peak 102 is subjected to dissociation for the $MS^2$ and subsequent spectrum measurements, and the structure is identified by referring to a database. In this way, it becomes possible, according to this example, to identify modified compounds.

EXAMPLE 13

An example according to the invention is described referring to Table 2. In Table 2, the mass number of one amino acid residue is compared with the sum of the mass numbers of two amino acid residues which is close to the former mass number. As seen from Table 2, the mass number of lysine (Lys) is almost equal to the total mass number of glycine (Gly) and alanine (Ala), for instance, and, thus, a low resolution apparatus cannot distinguish them. Therefore, in cases where Lys appears in the structure of a candidate structure of the relevant ionic species, Gly and Ala may be simultaneously contained in the actual ionic species.

Figure 10:
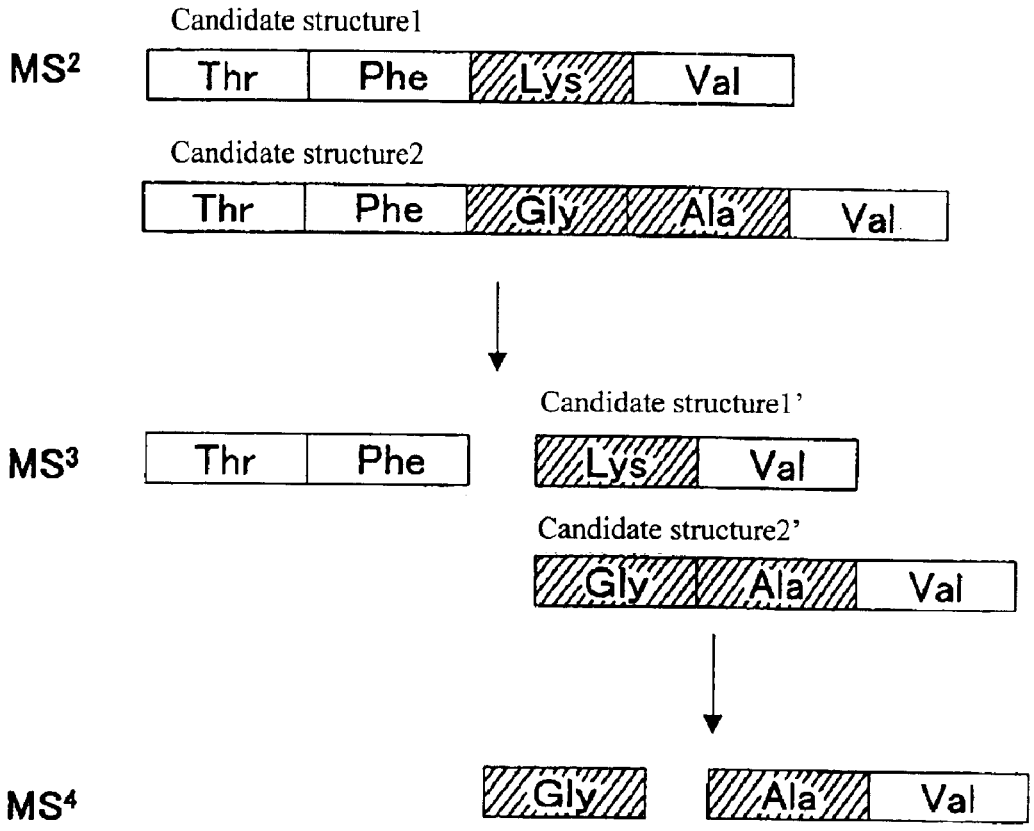
FIG. 10 is a mass spectrum analysis chart resulting from Example 13 according to the invention.

Regarding such a case, an explanation is made in the following, referring to the corresponding figure (FIG. 10). In the case of FIG. 10, the spectral data analyzing system gave the candidate structure 1 and candidate structure 2 to an ionic species measured in the stage of $MS^2$. This is because both structures could not be distinguished from each other due to the close approximation of the mass of Lys to the total mass of Gly and Ala, as mentioned above.

In such a case, the spectral data analyzing system further carries out the $MS^3$ measurement.

In this example where Lys and Gly-Ala cannot be distinguished from each other in the $MS^3$ measurement stage, an ionic species estimably containing Lys (or Gly-Ala) is further selected for carrying out the $MS^4$ measurement.

In $MS^4$, the bond between Gly-Ala is cleaved, and the ion of Gly alone is observed. Thus, it was found that the candidate structure 2 (or candidate structure 2') reflects the actual structure.

Thus, when the candidate structure contains an amino acid (or an amino acid pair) making a distinction difficult due to closeness in mass number, the structure can be identified by selecting an ionic species containing the amino acid.

As described above, it becomes possible, according to this example, to limit the number of candidate amino acid residue sequences and thereby improve the precision in structure identification.

EXAMPLE 14

Referring to Example 13, a method of ion selection paying attention to tryptophan is described in the following.

Tryptophan (Trp) has a mass number of 186.2 Da and is approximately the same or quite the same in mass number as a number of combinations of two amino acids, as shown in Table 2. Therefore, for judging whether an ionic species having a certain specific mass number contains tryptophan or other two amino acids such as given hereinabove, it is necessary to cause further dissociation for the measurement of Trp or an ionic species expected to have a mass number close to that of Trp.

According to this example, it is possible to limit the number of amino acid residue sequence candidates and improve the precision in structure identification.

EXAMPLE 15

A method of summing up all spectra obtained in the $MS^2$ and subsequent measurements in certain embodiments of the invention is now described.

Figure 11:
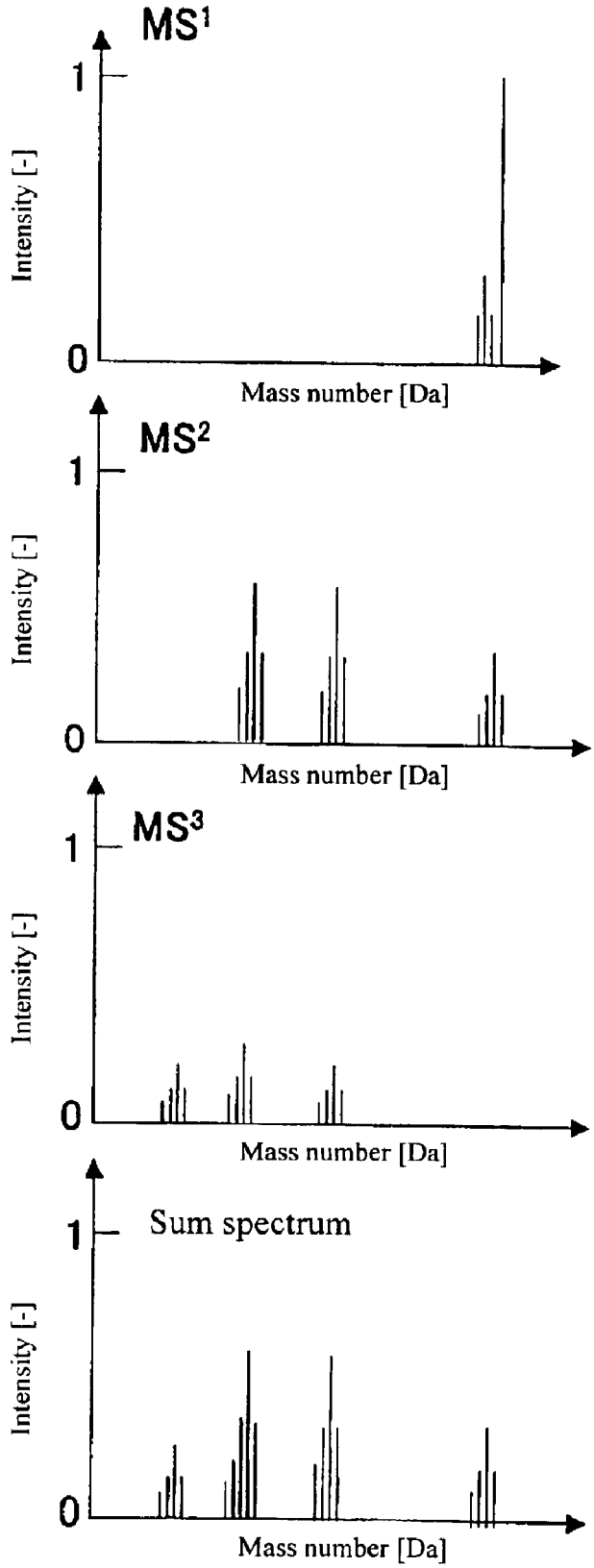
FIG. 11 is a mass spectrum analysis chart resulting from Example 15 according to the invention.

FIG. 11 shows the $MS^1$ to $MS^3$ spectra of a polypeptide. The software for structural analysis by matching with a conventional database cannot cope with the $MS^3$ and subsequent spectral analyses in many cases.

Therefore, for enabling amino acid sequence determination using such software, a spectrum is constructed by summing up the $MS^2$ and $MS^3$ spectra. In this example, the maximum spectral intensity in $MS^3$ is about one third as compared with $MS^2$. If the maximum spectral intensity in $MS^3$ is one tenth or lower as compared with $MS^2$, weighting treatment may be carried out by multiplying the $MS^3$ spectral values by a certain value. By processing the thus-formed sum spectrum with the analytical software, it becomes possible to make an amino acid sequence determination.

EXAMPLE 16

The same effects as obtained above in Examples 6 to 10 can also be produced when the measurement target is a sugar or a chemically modified sugar.

In the case of a sugar, the constituent units are not amino acids but are monosaccharides. Thus, the sequence of monosaccharides in the sugar chain can be revealed.

EXAMPLE 17

The same effects as obtained above in Examples 11 and 12 can also be produced when the measurement target is a sugar or a chemically modified sugar.

In the case of a sugar, the constituent units are not amino acids but are monosaccharides. Thus, by eliminating the chemical modifier, it is possible to reveal the unmodified sugar chain structure. Further, the structure of the modifier compound can be identified by measuring the modifier compound eliminated.

According to the invention, it is possible to measure the $MS^n$ (n>2) spectra and make a spectral identification in a shortened measurement time. It becomes possible to identify, with high precision, proteins, polypeptides, sugars, and chemically modified proteins and polypeptides, in particular.

What is claimed is:

1. A mass spectrum analyzing system using a tandem type mass spectrograph in which a measurement target substance is ionized and an ionic species having a specific mass number is selected from among the ionic species formed and is further dissociated, and such measurement target ionic species selection and dissociation are repeated in n stages, wherein whether the n-th stage tandem mass analysis is to be carried out or not is determined based on all mass-to-charge ratio (m/z) peaks obtained by the spectral measurement in the (n−1)th stage.

2. The mass spectrum analyzing system according to claim 1, wherein the ionic species selection in the tandem mass analysis in the n-th stage is made by a selection means built-in in the spectrograph or connected thereto from the outside based on all mass-to-charge (m/z) peaks obtained in the spectral measurement in the (n−1)th stage.

3. The mass spectrum analyzing system according to claim 1, wherein the mass spectrum obtained in the n-th stage of tandem mass analysis is compared with a database and, in case of agreement, the measurement is finished or, in case of nonagreement, the spectral measurement in the (n+1)th stage is carried out.

4. The mass spectrum analyzing system according to claim 1, wherein the mass spectrum obtained in the n-th stage of tandem mass analysis is compared with a database and, in case of agreement, the measurement is finished or, in case of nonagreement, the spectral measurement in the (n+1)th stage is carried out until an agreement with the database is obtained.

5. The mass spectrum analyzing system according to claim 1, wherein the ionic species selection and spectral measurement are repeated.

6. The mass spectrum analyzing system according to claim 1, wherein the measurement target is one of polypeptides, sugars, phosphoric acid, oxygen, hydrogen, alkyl groups, organic acid related compounds, and further other compounds, or is a protein, polypeptide or sugar chemically modified by such a compound.

7. The mass spectrum analyzing system according to claim 6, wherein the candidate structures of dissociated ionic species are predicted for a protein, polypeptide, chemically modified protein, or chemically modified polypeptide and, based on the results of the prediction, the sequence of amino acid residues constituting the peptide chain is predicted and, in case of failure to reveal the sequence exceeding M residues contained in the peptide chain, a dissociated ionic species containing the largest number of amino acid residues in the unknown sequence is selected and dissociated, and the ionic species selection and dissociation are repeated until the sequence exceeding M residues contained in the peptide chain becomes revealed.

8. The mass spectrum analyzing system according to claim 7, wherein the value of the above-mentioned M is 4, 5, 6 or 7.

9. The mass spectrum analyzing system according to claim 8, wherein the value of the above-mentioned M is specified by the measurer on the occasion of measurement or in a stage prior to measurement.

10. The mass spectrum analyzing system according to claim 1, wherein the mass spectra from the second to n-th stages are added, or weighted and added, and the resulting sum spectrum is used to estimate the structure of the measurement target.

11. The mass spectrum analyzing system according to claim 10, wherein the subsequent dissociation and measurement cycle is repeated until the total number of amino acid-due peak groups among the peak groups in the sum spectrum becomes not less than J.

12. The mass spectrum analyzing system according to claim 11, wherein the value of J is 4, 5, 6 or 7.

13. The mass spectrum analyzing system according to claim 11, wherein the value of the above-mentioned J is specified by the measurer on the occasion of measurement or in a stage prior to measurement.

14. The mass spectrum analyzing system according to claim 6, wherein said chemically modified protein or chemically modified polypeptide is deprived of the modifier compound in the n-th stage of dissociation, and the resulting modifier compound-free polypeptide or sugar is dissociated in the (n+1)th stage of dissociation.

15. The mass spectrum analyzing system according to claim 6, wherein said chemically modified protein or chemically modified polypeptide is deprived of the modifier compound in the n-th stage of dissociation, and the modifier compound is dissociated in the (n+1)th stage of dissociation.

16. The spectrum analyzing system according to claim 6, wherein when it is difficult, due to closeness of the mass number of one amino acid residue to the total mass number of two paired other amino aid residues as compared with each other, to judge whether there is one amino acid residue or a pair of two amino acid residues among the amino acids constituting a precursor ion as estimated form the spectral data obtained by the tandem mass analysis in n stages, an ionic species containing the amino acid or amino acid pair difficult to distinguish from each other is selected and subjected to dissociation.

17. The mass spectrum analyzing system according to claim 6, wherein when it is anticipated that the candidate structure of an ionic species contains one of tryptophan (Trp), asparagine (Asn), glutamine (Gln), glutamic acid (Glu) and arginine (Arg), an ionic species expectedly containing such amino acid residue is selected and subjected to dissociation.

18. The mass spectrum analyzing system according to claim 6, wherein the candidate structures of dissociated ionic species are predicted for a sugar or chemically modified sugar and, based on the results of said prediction, the monosaccharide sequence or the number of such sequences is estimated and, in case of failure to reveal the sequence of Ma or more monosaccharides in the sugar chain thereby, a dissociated ionic species most abundantly containing the monosaccharides the sequence of which is unknown is selected and subjected to dissociation, and the ionic species selection, dissociation and measurement cycle is repeated until the sequence of the Ma or more monosaccharides in the sugar chain is revealed.

19. The mass spectrum analyzing system according to claim 18, wherein the value of Ma is 4, 5, 6 or 7.

20. The mass spectrum analyzing system according to claim 18, wherein the value of Ma is specified by the measurer on the occasion of measurement or in a stage prior to measurement.

21. The mass spectrum analyzing system according to claim 10, wherein the subsequent dissociation and measurement cycle is repeated until the number of sugar-due peak groups among the peak groups in the sum spectrum becomes not less than Ja.

22. The mass spectrum analyzing system according to claim 21, wherein the value of the above-mentioned Ja is 4, 5, 6 or 7.

23. The mass spectrum analyzing system according to claim 21, wherein the value of the above-mentioned Ja is specified by the measurer on the occasion of measurement or in a stage prior to measurement.

* * * * *